United States Patent [19]

Tolmie, Jr.

[11] 4,312,468

[45] Jan. 26, 1982

[54] SYSTEM AND APPARATUS FOR COMPENSATING FOR THE DIFFERENCE BETWEEN THE ACTUATION AND RELEASE POINTS OF A SWITCH

[75] Inventor: Robert J. Tolmie, Jr., Brookfield Center, Conn.

[73] Assignee: Pitney Bowes Inc., Stamford, Conn.

[21] Appl. No.: 150,104

[22] Filed: May 15, 1980

[51] Int. Cl.[3] ..... B65H 25/00; G03G 15/00

[52] U.S. Cl. ..... 226/9; 355/13

[58] Field of Search ..... 226/9, 130, 131; 271/226, 265; 83/62, 362, 364; 355/13

[56] References Cited

U.S. PATENT DOCUMENTS

| | | | |
|---|---|---|---|
| 2,703,933 | 3/1955 | Blake | 226/9 X |
| 3,706,490 | 12/1972 | Aasen | 355/13 |
| 3,797,931 | 3/1974 | Miciukiewicz | 355/13 |
| 3,923,391 | 12/1975 | Washio | 355/13 |
| 4,012,139 | 3/1977 | Washio | 355/13 |
| 4,193,330 | 3/1980 | Knox | 83/364 |

*Primary Examiner*—Edward J. McCarthy
*Attorney, Agent, or Firm*—Peter Vrahotes; William D. Soltow, Jr.; Albert W. Scribner

[57] ABSTRACT

A system and apparatus for compensating for the difference between the actuation and release points of a switch resulting from a document being conveyed across the switch. This difference is brought about by the physical dimensions of a switch wherein it is actuated longer than the time required to indicate the dimensions of the actuating document.

4 Claims, 4 Drawing Figures

SYSTEM AND APPARATUS FOR COMPENSATING FOR THE DIFFERENCE BETWEEN THE ACTUATION AND RELEASE POINTS OF A SWITCH

BACKGROUND OF THE INVENTION

There are times when a switch will be actuated longer than it should be simply because of the physical dimensions of the switch. For example, when a switch is actuated by a document being conveyed across the switch, it will generally be actuated for a longer time than required to indicate the length of the moving document. This is because the contacting point of the switch will have a finite size and it takes excess time to actuate and release the switch because of the time taken for the document to transverse the distance represented by the location where the leading edge of the document first contacts the switch to close the same and the location where the trailing edge disengages from the switch to loose contact therewith and open the switch. This difference is defined in the specification as the difference between the actuation and release point of a switch. Methods have been attempted in the past to compensate for this difference including such schemes as anding two switches together. This simply involves the use of two switches that are both in contact with a document that is being conveyed with the two switches separated approximately the distance equal to the difference between actuation and the release points of the switches. The system is activated when both switches have been contacted by the document. This is obviously more expensive and somewhat less reliable because more parts are involved.

SUMMARY OF THE INVENTION

A switch over which documents are to pass is in electrical contact with a switch actuating delay circuit. This delay circuit is in electrical contact with a comparator which also receives a reference signal. The comparator controls a load such as a paper feed drive unit. When the switch actuation delay circuit sends a signal to the comparator that is higher than the reference signal received by the comparator, the comparator will send no pulse, but when the delay register circuit sends a lower signal to the comparator then the comparator will send a signal to operate a paper feed drive unit. The switch delay circuit will initially send a high signal to the comparator and after a delay equal to the time it takes the document to traverse the actuation and release point of the switch, the delay circuit will then send a low signal to the comparator that will then start the paper feed drive unit.

DETAILED DESCRIPTION OF THE PREFERRED EMBODIMENT

Figure 1B:
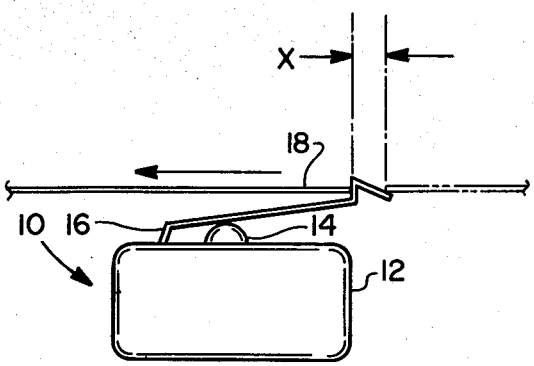
FIGS. 1*a* and 1*b* are longitudinal views of a switch before and after actuation by a document being conveyed thereacross, respectively.
Figure 1A:
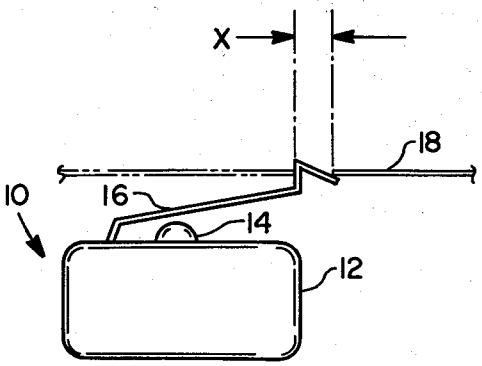

A switch is generally shown at 10 and includes a housing 12 having a first contact 14 and a second contact 16 in the form of an arm, the switch being actuated or closed when the two contacts are in engagement with one another. A document 18 is moved in the direction shown by the arrow in FIGS. 1*a* and 1*b* so as to engage the arm 16 to push it downwardly into engagement with the contact 14. The arm 16 will be pushed downwardly when the leading edge of a document 18 engages the arm and will be kept down until such time as the trailing edge of the document 18 disengages from the arm. Because of such contact with the arm 16, the document 18 will hold the arm 16 for a period longer than the period required to indicate the length of the document 18 so that the length of the document 18 would appear to be greater by a distance "X" as indicated in FIGS. 1*a* and 1*b* which difference is referred to as the difference between actuation and release point of the switch 10.

Figure 2:
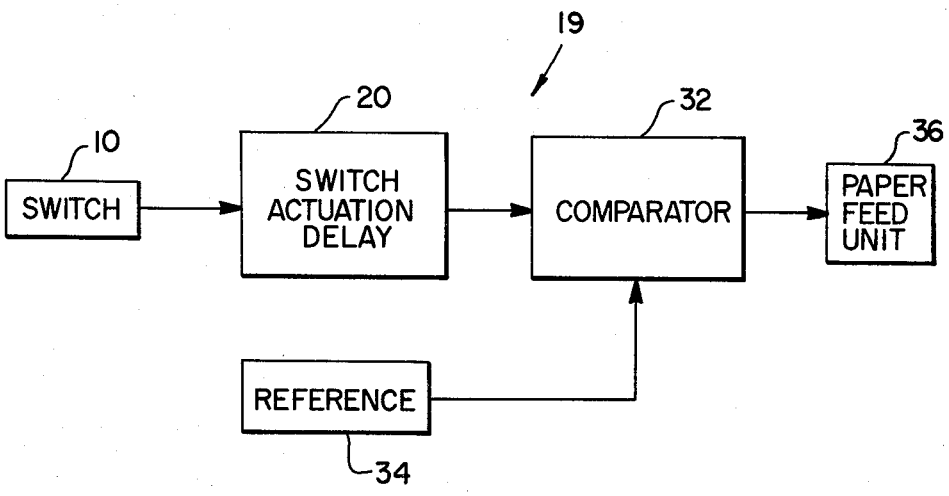
FIG. 2 is a block diagram of circuitry that incorporates features of the instant invention.
Figure 3:
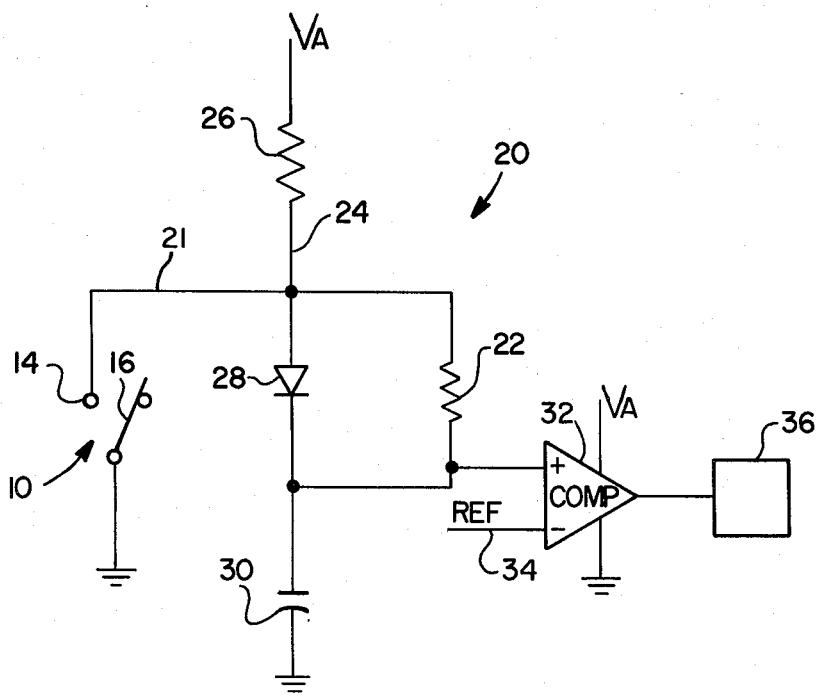
FIG. 3 shows details of the circuitry of the block diagram shown in FIG. 2.

Referring now to FIG. 2, in order to compensate for the difference between the actuation point and the release point of the switch 10, a switch actuation delay system 19 is provided that includes a delay register 20 that is coupled to a comparator 32. The comparator 32 is also coupled with a reference signal source 34. The delay register 20 initially sends a signal that is equal to or higher than the reference signal. The level of the signal from delay register 20 will then become lower than the reference signal, at which time the comparator 32 will send a signal that will actuate a paper feed drive unit 36. More specifically and with reference to FIG. 3, a circuit is shown wherein such compensation may be obtained. As shown in FIG. 3, the contact arm 16 is connected to ground and will engage the contact 14 upon a document 18 pushing the same into engagement therewith. The contact 14 has a lead 21 extending therefrom which has a resistor 22 included therein. An example of a resistor that may be used is one having 600,000 ohms. A second lead 24 is in electrical contact with the first lead 21 and has a resistor 26 therein, as for example a 20,000 ohm resistor. A diode 28 and a capacitor 30 are in series with the resistor 26.

The comparator 32 is in electrical connection with the leads 21 and 24 and with the source of the reference signal 34. The comparator 32 is coupled to a load 36 which may be a paper feed unit.

In operation, when the contacts 14 and 16 are closed as by a document 18 pushing the arm 16 downwardly, the capacitor 30 will be discharged and the signal received by the comparator 32 from the delay circuit 20 will initially be high. Because the incoming signal is higher than the reference signal 34, the comparator 32 will not become enabled. As the capacitor 30 is discharged, the signal received by the comparator 32 will go lower than the reference signal 34 and, consequently the comparator 32 will be enabled to send a signal to the paper feed unit 36. The rating of the capacitor 30 is chosen such that the time required for the capacitor to discharge is equivalent to the time for the document to pass a distance "X", this distance X, of course, being the difference between the actuation point and release point of the switch 10. The diode 28 eliminates any delay as the trailing edge leaves the release point by causing the resistor 22 to be bypassed. In this way, when a reading is received by the paper feed unit document 36 it is a true measure of the length of the document 18 being conveyed across the switch 10 and not one that also includes an error in the timing due to the physical dimensions of the switch.

An example of an application of the instant invention is in the electrostatic copier field. An original document is conveyed past an exposure station with its image reflected onto a photoconductive drum. Copy paper in the form of a roll is fed by the paper feed unit and when the length of the document is duplicated, the copy paper roll is cut. Without the use of the instant invention, the copy paper would consistantly be cut a greater length than the length of the original document.

What is claimed is:

1. A system that compensates for difference between the actuation point and the release point of a switch that is actuated by a document moving thereacross, comprising: a switch, delay means coupled to said switch, said delay means being operative to send an initially high signal that decreases in value, a comparator in electrical connection with said delay means, a reference signal means, operative to send a reference signal to said comparator and a load in electrical connection with said comparator wherein said comparator compares the output from said delay means with said reference signal and becomes enabled when said signal from said delay means is of a value lower than said reference signal to thereby send an actuating signal to said load.

2. The system of claim 1 wherein said load is a paper feed unit.

3. A system that compensates for differences between the actuation point and the release point of a switch that is actuated by a document moving thereacross, comprising: a switch, a first resistor in series in with said switch, a second resistor in electrical connection with said switch, said second resistor being in series with a diode and a capacitor, a comparator in electrical connection with said first resistor and said capacitor source operative to send a reference signal to said comparator, and a load in electrical connection with said comparator whereby upon said switch being closed said capacitor discharges to send a switch signal to said comparator which is initially high but which decreases as said capacitor discharges; said comparator becoming enabled when said switch signal is less than said reference signal to thereby send an actuating signal to said load.

4. The system of claim 3 wherein said load is a paper feed unit.

* * * * *